US005244292A

United States Patent [19]

Wise

[11] Patent Number: 5,244,292

[45] Date of Patent: Sep. 14, 1993

[54] BABY CARRIER

[75] Inventor: Robert D. Wise, Akron, Ohio

[73] Assignee: Century Products Company, Macedonia, Ohio

[21] Appl. No.: 883,938

[22] Filed: May 12, 1992

Related U.S. Application Data

[60] Continuation of Ser. No. 630,099, Dec. 19, 1990, abandoned, which is a division of Ser. No. 471,685, Jan. 26, 1990, Pat. No. 4,986,599, which is a continuation of Ser. No. 356,972, May 24, 1989, abandoned, which is a continuation of Ser. No. 876,960, Jun. 20, 1986, Pat. No. 5,011,221, which is a continuation of Ser. No. 550,261, Nov. 8, 1983, Pat. No. 4,634,175.

[51] Int. Cl.[5] ..... A47D 13/02; F16C 11/10

[52] U.S. Cl. ..... 403/93; 297/183; 403/83

[58] Field of Search ..... 297/183, 363-372, 297/377; 403/83, 92-97

[56] References Cited

U.S. PATENT DOCUMENTS

| | | | |
|---|---|---|---|
| 199,505 | 1/1878 | Britton | 297/365 X |
| 4,231,612 | 11/1980 | Meeker | 297/327 X |
| 4,371,206 | 2/1983 | Johnson, Sr. | 297/377 X |

*Primary Examiner*—Peter R. Brown

*Attorney, Agent, or Firm*—Graham & James

[57] ABSTRACT

A baby carrier 10 having on its underside an integral pair of rockers 12 with a wedge shape pouch 13 detachably secured between the rockers, and having a support handle 14 rotatably connected to the sides of the carrier by a pair of pivots 15 which can be locked in various positions for use of the carrier to carry a baby, as a rocker, or as a chair.

6 Claims, 3 Drawing Sheets

BABY CARRIER

This is a file wrapper continuation of Ser. No. 07/630,099, filed Dec. 19, 1990, now abandoned, which was a continuation of application Ser. No. 07/356,972 filed May 24, 1989, now abandoned, which was a continuation of application Ser. No. 06/876,960 filed Jun. 20, 1986, now abandoned, which was a continuation of application Ser. No. 06/550,261 filed Nov. 8, 1983, now U.S. Pat. No. 4,634,175 issued Jan. 6, 1987.

BACKGROUND OF THE INVENTION

1. Field of the Invention

The present invention relates to baby carriers and particularly to one which can be used as a rocker, with a storage compartment and an improved handle.

2. Prior Art

Baby carriers have been designed in the prior art to sit on a floor at an adjustable angle and support a baby reclining on its back. U.S. Pat. No. 3,361,473 to Dudouyt teaches a chair having a seat and a back connected to legs by a clampable pivot, allowing the parts to be moved relative to each other. U.S. Pat. No. 3,492,047, also to Dudouyt, teaches a one-piece shell seat having a support including a front foot, a rear foot, and linkages, allowing the seat to be shifted to various angles or allowing the support to be shifted to the front of the seat to serve as a restraining cross bar. A one-piece shell seat, disclosed in U.S. Pat. No. D252,118 to Meeker, has a front foot, a rear foot, and braces, and apparently can be adjusted to different angles by a three-pronged gear. An infant's shell seat chair disclosed in U.S. Pat. No. 3,409,325 to Hamilton has a one-piece U-shaped support which swings around the top of the chair back for use as a carrying handle. The Hamilton chair has hinges comprising opposing disks each with radial teeth. Another seat hinge having radial teeth on opposing disks is disclosed in U.S. Pat. No. 3,099,485 to Beierbach. A hinge having parallel teeth on concentric barrels, not specifically for use in a chair, is disclosed in U.S. Pat. No. 2,921,773 to Hoelzer.

Another type of baby carrier is adapted for use as a rocker as well. For example, one type of available baby carrier, called the Kolkraft CARRI-CRADLE, uses rockers which are extensions of sides of the shell. Another type, sold by the Questor Corporation of Toledo, Ohio, as the MAXI-ROCKER, uses metal tubing attached to the sides and bottom of the shell.

Although the prior art baby carriers serve certain functions, several problems associated with baby carriers remain unsolved. For example, carrying a baby in a carrier makes it difficult to carry other items for the baby. There is a need, therefore, for a more versatile baby carrier which provides a more convenient means of carrying a baby and accessories.

SUMMARY OF THE INVENTION

The baby carrier of the present invention comprises a one-piece shell type seat having a generally U-shaped support rotatably attached to the sides of the shell by simple, reliable and convenient pivots. The bottom of the shell forms an integral pair of rockers allowing use of the carrier as a rocking cradle. The pivots can be locked in various predetermined positions, to serve various functions, for example, a carrying handle, folded compactly for storage, a stop for using the carrier as a napping rocker, or a prop for using the carrier as for feeding and playing. A detachable fabric carrying pouch is preferably provided beneath the carrier between the rockers for storing various items. The pouch does not interfere with other uses of the carrier and is very handy for carrying items when moving the cradle and baby about.

The present invention thus provides a baby carrier which is versatile—acting as a chair, a rocker or a one-handed carrier—through the use of the novel pivots. The pouch permits items to be conveniently carried along with the carrier and baby and yet allow unhindered use of the carrier as a chair or as a rocker.

DETAILED DESCRIPTION OF THE PREFERRED EMBODIMENT

Figure 1:
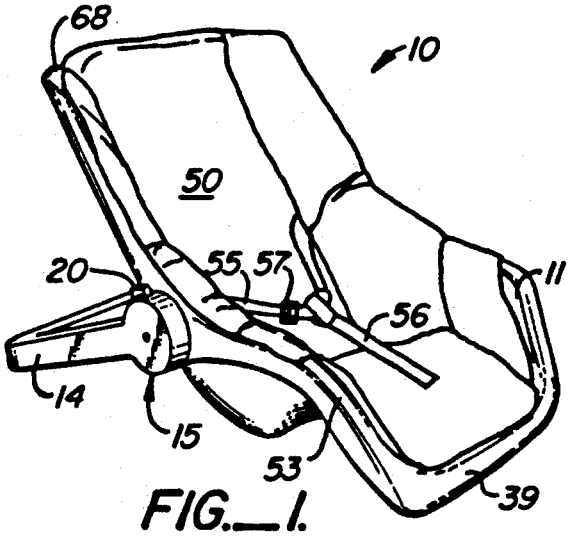
FIG. 1 is a front left perspective view of the baby carrier embodying the present invention.
Figure 2:
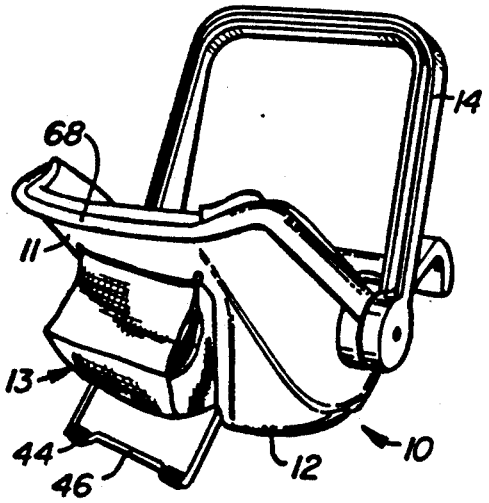
FIG. 2 is a rear left perspective view of the baby carrier.
Figure 3:
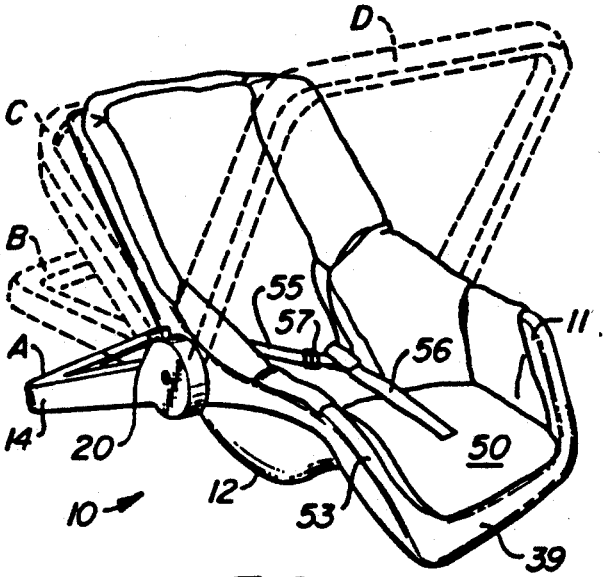
FIG. 3 is a perspective like FIG. 1 and showing the support in dotted outline in its various positions.

Referring to FIGS. 1 through 3, the present invention is a baby carrier 10 comprising a shell-type seat 11 having integral rockers 12, a separate storage pouch 13 suspended between rockers 12, and a rotatable support 14 connected by pivots 15 to shell 11. Pivots 15 can be locked in several predetermined orientations to facilitate different uses of the carrier. For example, as shown in FIG. 3, support 14 can be locked in position A to use carrier 10 as a seat for a baby to eat or play in, position B to use the carrier as a napping rocker, position C to store the carrier, and position D to carry a baby.

Figure 6:
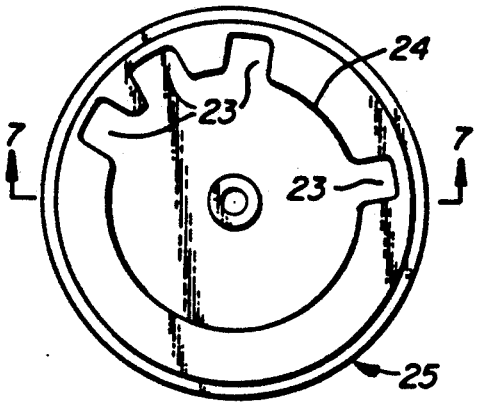
FIG. 6 is a view of the outward facing side of the left hub gear.
Figure 7:
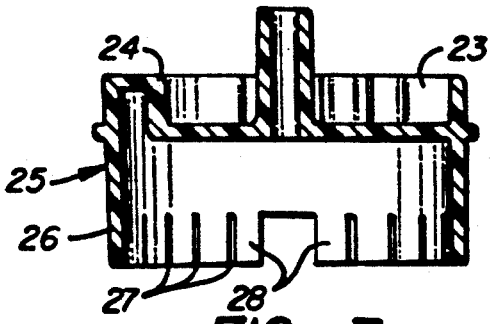
FIG. 7 is a cross-sectional side view of the left hub gear.
Figure 4:
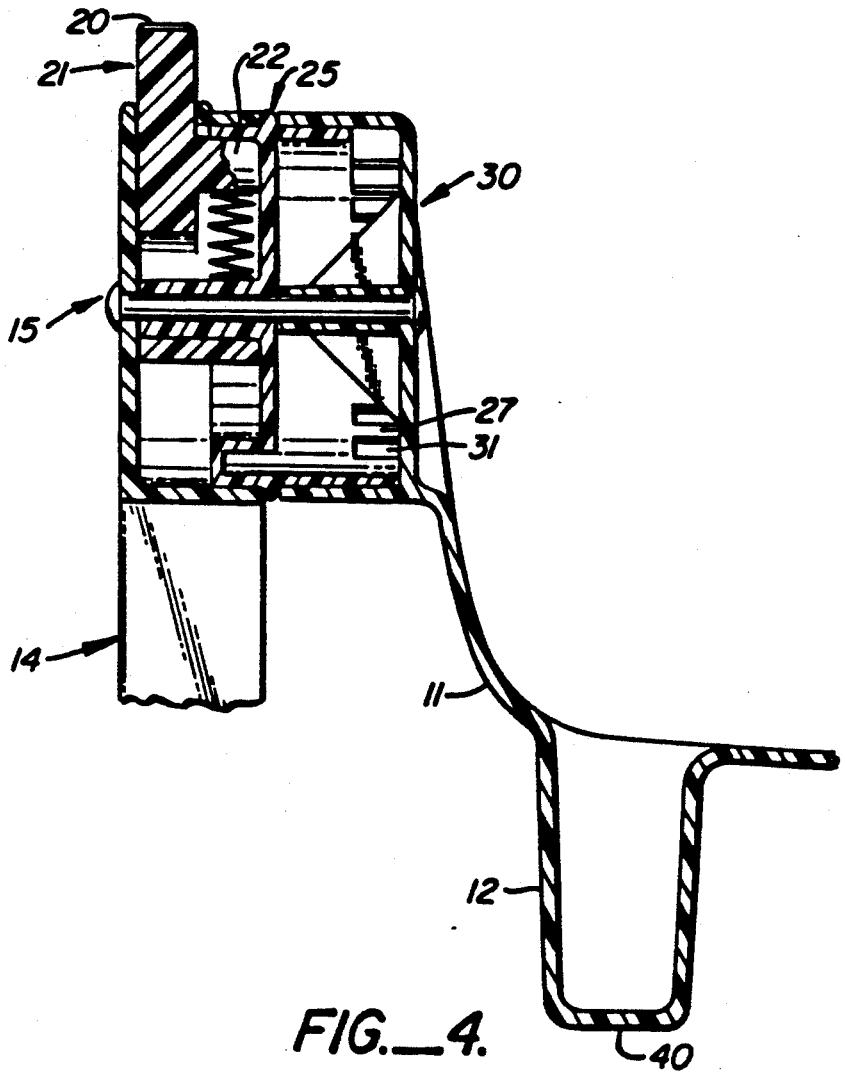
FIG. 4 is a front view cross-section taken through the left side of the seat shell, hub gear, plunger, and support hub cap.
Figure 5:
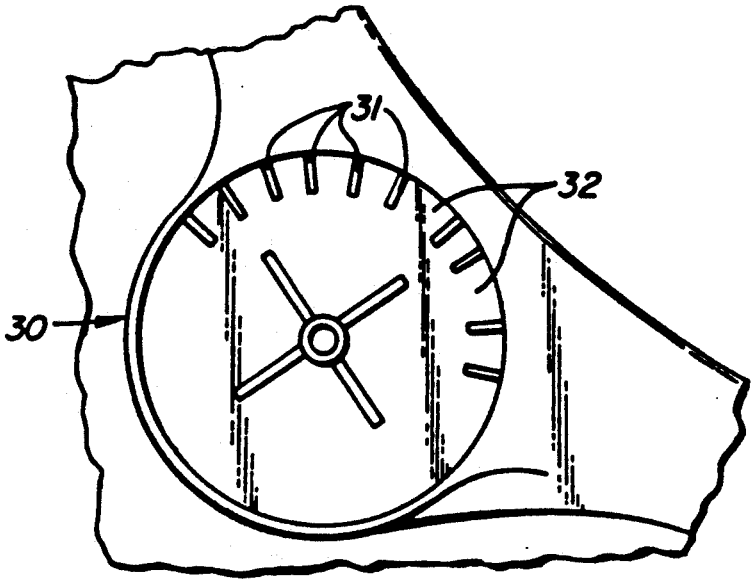
FIG. 5 is a left side elevation of the seat shell with the support and hub gear removed.
Figure 8:
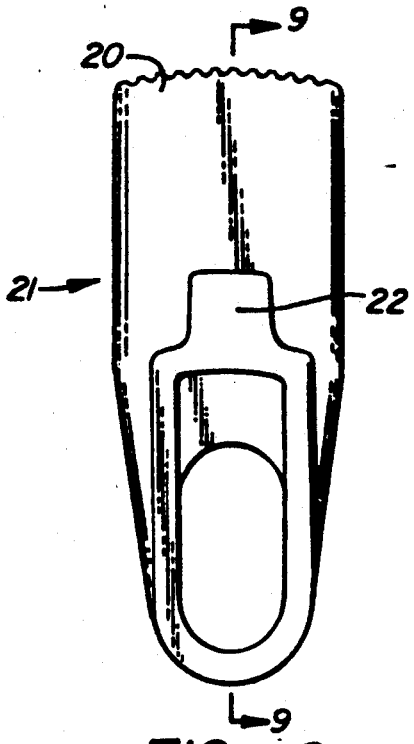
FIG. 8 is an elevation of the plunger.
Figure 9:
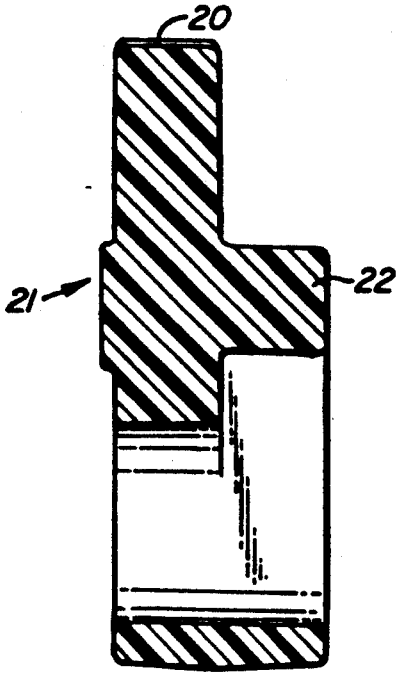
FIG. 9 is a cross-sectional side view of the plunger.

The support is positioned by pressing handle buttons 20 simultaneously with both hands, rotating support 14, and releasing the buttons to lock them. Referring to FIG. 4 a plunger 21 (FIGS. 8 and 9) holds support 14 in place, or permits it to rotate, through a plunger peg 22 interacting with notches 23 in the rim 24 of hub gear 25 (FIG. 6), which gear in turn is fixedly united with shell 11 through a second rim 26 (FIG. 7) interlocked with shell cup portion 30 (FIG. 5). Cup 30 has a series of radial tabs 31, interrupted by one or more gaps 32, and rim 26 has a series of parallel slots 27, interrupted by one or more unslotted arcs 28 (FIG. 7), allowing the second rim slots 27 to engage cup tabs 31 at the proper angle, but not otherwise. With hub gears 25 on both sides thus fixed at the correct orientation, notches 23 will also be correctly oriented to lock support 14 in the intended positions.

Near the foot 39 of carrier 10 each of the rockers 12 has, on its floor contacting bottom surface 40, a gripping pad 41 to stop the carrier from slipping when it is used as a chair with support 14 in position A.

Figure 10:
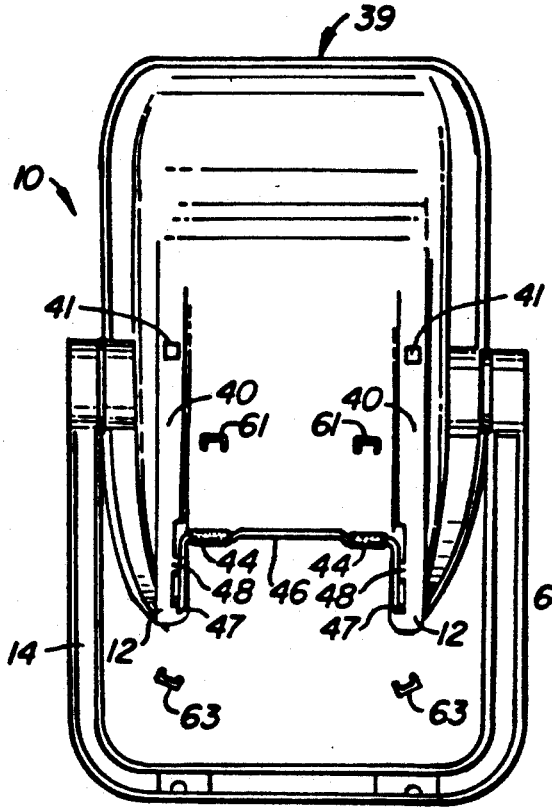
FIG. 10 is a bottom view with the pouch removed and showing the rockers.

A prop 46 (FIGS. 2 and 10, preferably heavy gauge metal wire, is rotatably mounted in a pair of holes 47, one in the inside of each of the rockers 12. Prop 46 can be clamped in a pair of clips 48 on the inside of respective rockers 12, or swung down and held by ridges (not shown) to prevent carrier 10 from rocking, regardless of the position of support 14. Prop 46 preferably has non-skid plastic sleeves 44.

The inside surface of shell 11 is lined with an upholstery pad 50 (FIGS. 1 and 3), preferably water repellent fabric or plastic. Pad 50 is anchored to arm rests 53 by fasteners (not visible), which may be plastic screws or clips, passing through holes in arm rest 53. The tops of the fasteners are preferably concealed under a top layer of pad 50. The fasteners are preferably removable to allow access to the facing surfaces of the shell and pad for cleaning with soap and water.

Seat 11 is also preferably provided with a waist strap 55 and a crotch strap 56, made for example of nylon webbing, and securable by a buckle 57 to prevent a baby from falling out of the carrier.

Figure 11:
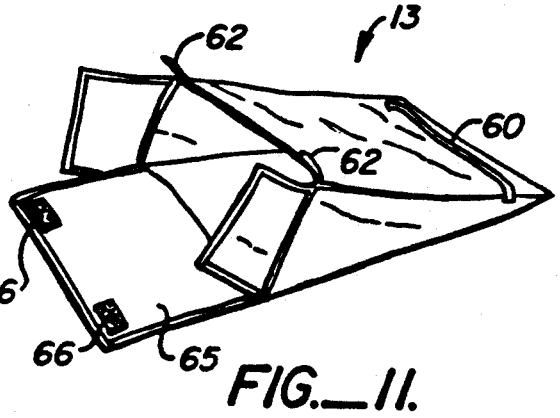
FIG. 11 is a view of the carrying pouch detached from the carrier.

On the underside of the shell, between rockers 12, a carrying pouch 13 (FIGS. 2 and 11) is preferably provided for convenience in storing and carrying various items. Pouch 13 is wedge shaped to fully occupy the space between the rockers, without interfering in chair or rocker movement of the carrier. Pouch 13 is detachably secured by a non-elastic tie 60 wrapped around plastic tabs 61 at the foot of the underside 45 of shell 11, and by elastic ties 62 which are stretched and hooked around plastic tabs 63 towards the head of underside 45. Pouch 13 has a closeable flap 65 which has Velcro TM strips 66 complementary to Velcro TM strips 67 on the opposite side of the pouch. Pouch 13 is preferably made of washable water resistant fabric so that it can be washed.

Details have been disclosed to illustrate the invention in a preferred embodiment of which adaptations and modifications within the spirit and scope of the invention will occur to those skilled in the art. The scope of the invention is limited only by the following claims.

What is claimed is:

1. An adjustable latch mechanism, comprising:

a generally cylindrical cup;

a member rotatably mounted to said cup by a pivot means, the member having a guide along a perimeter surface;

a hub gear at least partially disposed in said cup and positioned generally between the cup and the member and including a circumferential rim and a plurality of notches in said rim;

a series of radial tabs on said hub gear and corresponding slots on said cup for rotationally securing the hub gear and the cup in a preselected relative position;

a plunger extending radially from said pivot means slidably moveable in said guide between a first position and a second position along a first axis, the plunger including a button end, a plunger peg extending generally traverse to the first axis and configured to releasably engage at least one said notch, and an elongated slot opposite the button end circumscribing the pivot means and providing stop surfaces limiting travel of the button end along the first axis towards and away from the pivot means;

a resilient member disposed between the plunger peg and the pivot shaft along a second axis, the second axis spaced apart from the first axis, the resilient member abutting the plunger peg and biasing the plunger peg away from the pivot means into said notch upon alignment of said notch with the second axis and thereby retain the member in a rotationally secured position relative to said cup.

2. A latch mechanism for a baby carrier having a shell-type seat, comprising:

a generally cylindrical cup;

a support member rotatably mounted to said cylindrical cup by a pivot shaft, said support member having an aperture at its perimeter;

a hub gear, disposed on said pivot shaft generally between said cylindrical cup and said support member, including a rim having a plurality of notches therein;

a series of radial tabs on said hub gear and corresponding slots on said cylindrical cup for rotationally interlocking said hub gear and cup in a preselected relative position;

a plunger extending radially from said pivot shaft and slidably disposed in said aperture, said plunger including a plunger peg configured to releasably engage at least one of said plurality of notches; and a spring disposed between said plunger peg and said pivot shaft, biasing said plunger away from said pivot shaft, wherein said spring causes said plunger peg to extend into and engage at least one of said plurality of notches upon alignment of said plunger peg therewith, to retain said member in a rotationally secured position relative to said cup.

3. The latch mechanism of claim 2 wherein the hub gear is substantially housed within the member and the cup collectively.

4. The latch mechanism of claim 2 wherein the rotationally interlocking means includes mating tabs and slots.

5. The latch mechanism of claim 4 wherein the tabs are integral with said cup and the slots are integral with said gear hub.

6. The latch mechanism of claim 2 wherein the plunger includes a stop end and a button end, the stop end configured to circumscribe the pivot shaft and provide stop surfaces limiting travel of the plunger relative to said pivot shaft.

* * * * *